US005715657A

United States Patent [19]

Mondani et al.

[11] Patent Number: 5,715,657

[45] Date of Patent: Feb. 10, 1998

[54] METHOD OF EXPANDING AND FEEDING CARTONS TO A FILLING LINE

[75] Inventors: Alberto Mondani, Bologna; Luciano Nannini, Casalecchio; Giulio Strazzari, Bologna, all of Italy

[73] Assignee: Azionaria Costruzioni Macchine Automatiche A.C.M.A. S.p.A., Bologna, Italy

[21] Appl. No.: 540,055

[22] Filed: Oct. 6, 1995

[30] Foreign Application Priority Data

Oct. 7, 1994 [IT] Italy ..... B094A0439

[51] Int. Cl.[6] ..... B65B 43/12

[52] U.S. Cl. ..... 53/457; 153/458; 153/381.1; 493/313; 493/315; 493/316; 493/317

[58] Field of Search ..... 53/458, 457, 381.1, 53/579; 493/313, 315, 316, 317, 310

[56] References Cited

U.S. PATENT DOCUMENTS

| | | | |
|---|---|---|---|
| 4,709,538 | 12/1987 | Olsen, Jr. et al. | 53/381.1 |
| 5,027,586 | 7/1991 | Ramaker | 53/458 |
| 5,067,937 | 11/1991 | Aschaker et al. | 493/315 |
| 5,102,385 | 4/1992 | Calvert | 493/315 |
| 5,104,369 | 4/1992 | Calvert | 493/315 |
| 5,298,008 | 3/1994 | Decker et al. | 493/315 |
| 5,562,581 | 10/1996 | Roberto et al. | 53/579 |

FOREIGN PATENT DOCUMENTS

| | | | |
|---|---|---|---|
| 0 234228 | 9/1987 | European Pat. Off. . | |
| 0 425226 | 5/1991 | European Pat. Off. . | |
| 0 510953 | 10/1992 | European Pat. Off. . | |
| 0558347 | 9/1993 | United Kingdom | 53/458 |

*Primary Examiner*—John Sipos
*Assistant Examiner*—Gene L. Kim
*Attorney, Agent, or Firm*—Oblon, Spivak, McClelland, Maier & Neustadt, P.C.

[57] ABSTRACT

A method of expanding and feeding cartons to a filling line; the cartons being made of sheet material, presenting four walls defined by preformed bend lines, and being expanded as of an initial flattened configuration wherein each carton is arranged in two superimposed, substantially contacting layers, each defined by two adjacent walls of the carton; each carton being expanded by rotating each wall of each layer about an arc of over 90° in relation to the other wall of the same layer and into a configuration causing yielding of the bend lines; and by only permitting each carton to assume its final parallelepiped-section configuration inside the conveyor pocket of the filling line.

12 Claims, 2 Drawing Sheets

METHOD OF EXPANDING AND FEEDING CARTONS TO A FILLING LINE

BACKGROUND OF THE INVENTION

The present invention relates to a method of expanding and feeding cartons to a filling line.

Packing machines include what are known as cartoning machines, the input store of which is supplied with stacks of tubular cartons, each initially arranged flat in two superimposed, substantially contacting layers which are integral with each other along two preformed outer bend lines, and are each defined by two adjacent walls of the carton integral with each other along a respective preformed inner bend line.

Known cartoning machines, such as those described in European Patent Applications n. 100,143 and n. 132,617, comprise gripping members, normally in the form of suction cups, which are moved by a rotary conveyor along a circular path, and at the same time are moved by an epicyclic transmission in relation to the rotary conveyor, so as to orbit about their own axis parallel to the rotation axis of the conveyor. The combination of the above two movements causes each gripping member—which is arranged crosswise to its rotation axis—to engage a respective carton at the outlet of the feedbox, to roll on the outlet of the feedbox so as to withdraw and at the same time partly open the carton, and to feed the partly opened carton towards the rotation axis of the conveyor along an arc, at the end of which the carton is positioned outside the rotary conveyor and substantially tangent to a pocket type filling conveyor traveling in the opposite direction to that of the carton in said tangent position. Upon one of said two preformed outer bend lines of the carton striking the downstream shoulder of a pocket on the filling conveyor, the carton is opened fully into the final parallelogram-section shape, and is detached from the gripping member.

The above method adopted on known cartoning machines for withdrawing and successively feeding the open cartons to the filling conveyor presents several drawbacks, the foremost of which derives from the fact that each carton is opened gradually into the fully open configuration inside the respective pocket on the filling conveyor. As such, unless the pocket is extremely accurate and capable of maintaining the carton in the precise fully open configuration, the carton tends to spring back to its initial flattened configuration, and assumes an intermediate configuration which creates problems for axially inserting the product, e.g. a bar of soap, inside the carton.

SUMMARY OF THE INVENTION

It is an object of the present invention to provide a method of expanding and feeding cartons to a filling line, and designed to overcome the aforementioned drawback.

According to the present invention, there is provided a method of expanding and feeding cartons to a filling line; the cartons being made of sheet material, presenting four walls defined by preformed bend lines, and being expanded as of an initial flattened configuration wherein each carton is arranged in two superimposed, substantially contacting layers which are integral with each other along two first said bend lines, and are each defined by two adjacent walls of the carton integral with each other along a respective second said bend line; the method being characterized in that each carton is expanded by rotating each wall of each layer about an arc of over 90° in relation to the other wall of the same layer, and into a configuration causing yielding of the bend lines; and by only subsequently permitting each carton to assume the final parallelogram-section configuration.

In the above method, at least part of the rotation of each wall of each carton is preferably performed by engaging a first wall of a first of said two layers via engaging means; effecting a first movement of the engaging means in relation to stop means and in a shift direction substantially tangent to said first wall, so as to bring into contact with said stop means an intermediate portion of a second wall of said first layer, located in front of the respective said first wall in said shift direction; and effecting a second movement of the engaging means in relation to the stop means in said shift direction, so as to position the second bend line of the first layer beyond the stop means.

Also, said first and second movements are preferably part of an oscillating movement of said engaging means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
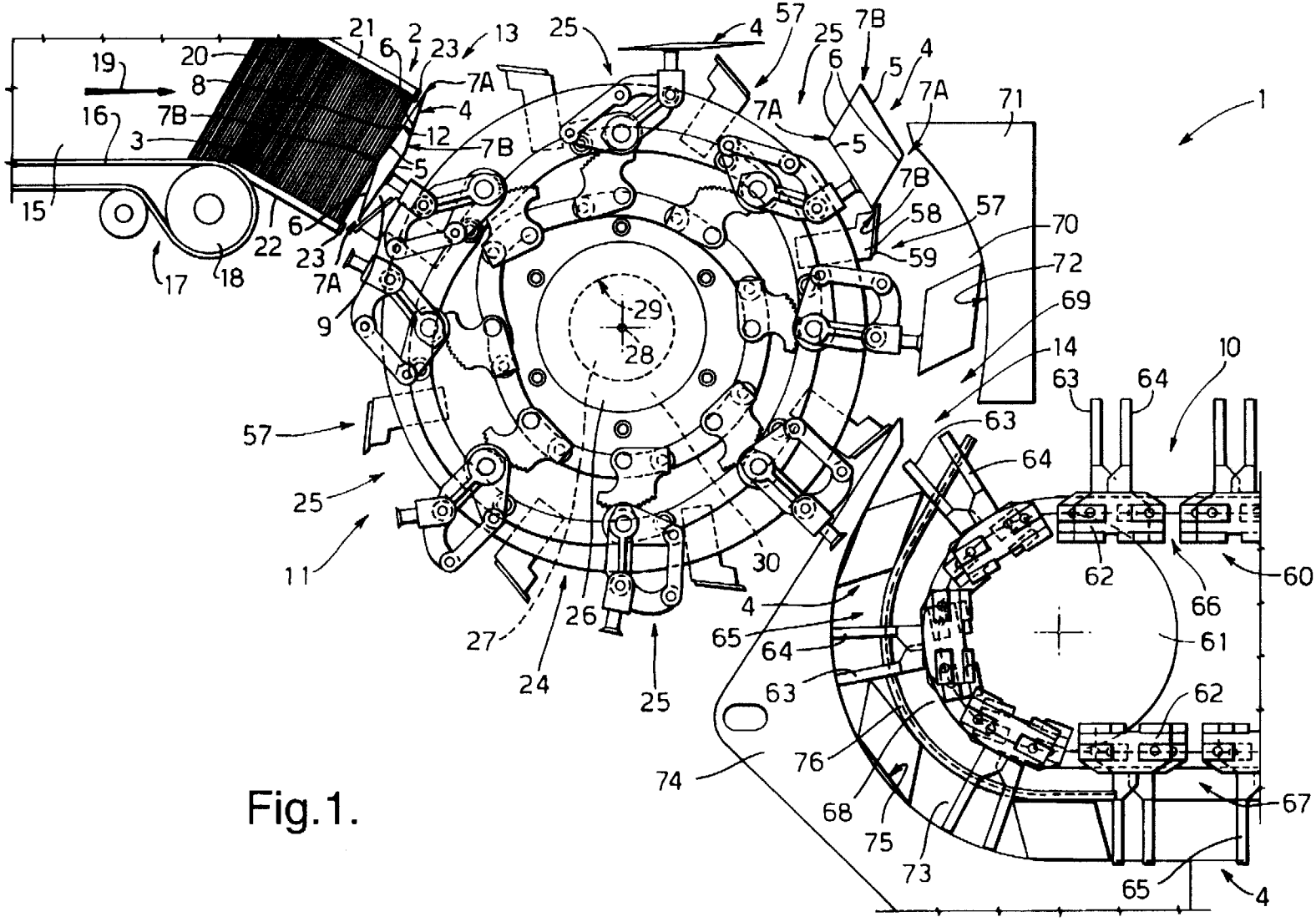
FIG. 1 shows a schematic side view, with parts removed for clarity, of a preferred embodiment of the carton expanding and feed device according to the present invention.

Number 1 in FIG. 1 indicates a cartoning machine comprising an input feedbox 2 for a stack 3 of tubular cartons 4, each presenting, in the fully expanded or open configuration, a parallelogram section defined by two parallel walls 5, and two parallel walls 6 perpendicular to walls 5, and wherein each wall 5, 6 is connected to the two adjacent walls 6, 5 along respective preformed longitudinal bend lines.

In stack 3, cartons 4 are arranged in an initial flattened configuration in which walls 5 and 6 are folded into two superimposed, substantially parallel layers 8 and 9, each of which is connected to the other along two outer lines indicated 7A, and is defined by a wall 5 and a wall 6 coplanar with each other and connected along an inner line indicated 7B.

Machine 1 also comprises a filling conveyor 10 for successively feeding cartons 4, in the fully open configuration, through a filling station (not shown) where they are filled axially with articles (not shown); and an expanding or opening conveyor 11 which provides for successively withdrawing cartons 4 from the outlet 12 of feedbox 2 at a loading station 13, for expanding cartons 4 as of the initial flattened configuration, and for transferring them to conveyor 10 at a transfer station 14.

As shown in FIG. 1, feedbox 2 comprises a substantially horizontal input conduit 15, the bottom wall of which, for supporting a stack 3 of cartons 4 arranged on edge in the flattened configuration, is defined by the transportation branch 16 of a conveyor belt 17 looped about two pulleys 18 (only one shown), at least one of which is powered to move belt 17 clockwise in FIG. 1. On branch 16, cartons 4 are supported in a slightly forward-tilted position, and are fed by branch 16 in direction 19 to the end portion of feedbox 2 defined by a channel 20 substantially crosswise to cartons 4 and terminating at outlet 12. Channel 20 slopes downwards from the outlet end of conduit 15, and is defined by a top and bottom wall 21, 22 parallel to each other and presenting, at outlet 12, respective transverse teeth 23 extending towards each other and for preventing cartons 4 from being simply pushed out through outlet 12 by belt 17.

With reference to FIG. 1, conveyor 11 comprises a conveyor wheel 24, and a number of engaging or gripping units 25 equally spaced about the periphery of wheel 24. Wheel 24 is annular with its inner periphery connected integral with the outer periphery of the end flange 26 of a drive shaft 27 which rotates wheel 24 clockwise (in FIG. 1) about its axis 28 perpendicular to the FIG. 1 plane and crosswise to direction 19, and which extends through a central hole 29 formed through a fixed face cam 30 facing and coaxial with wheel 24.

Figure 2:
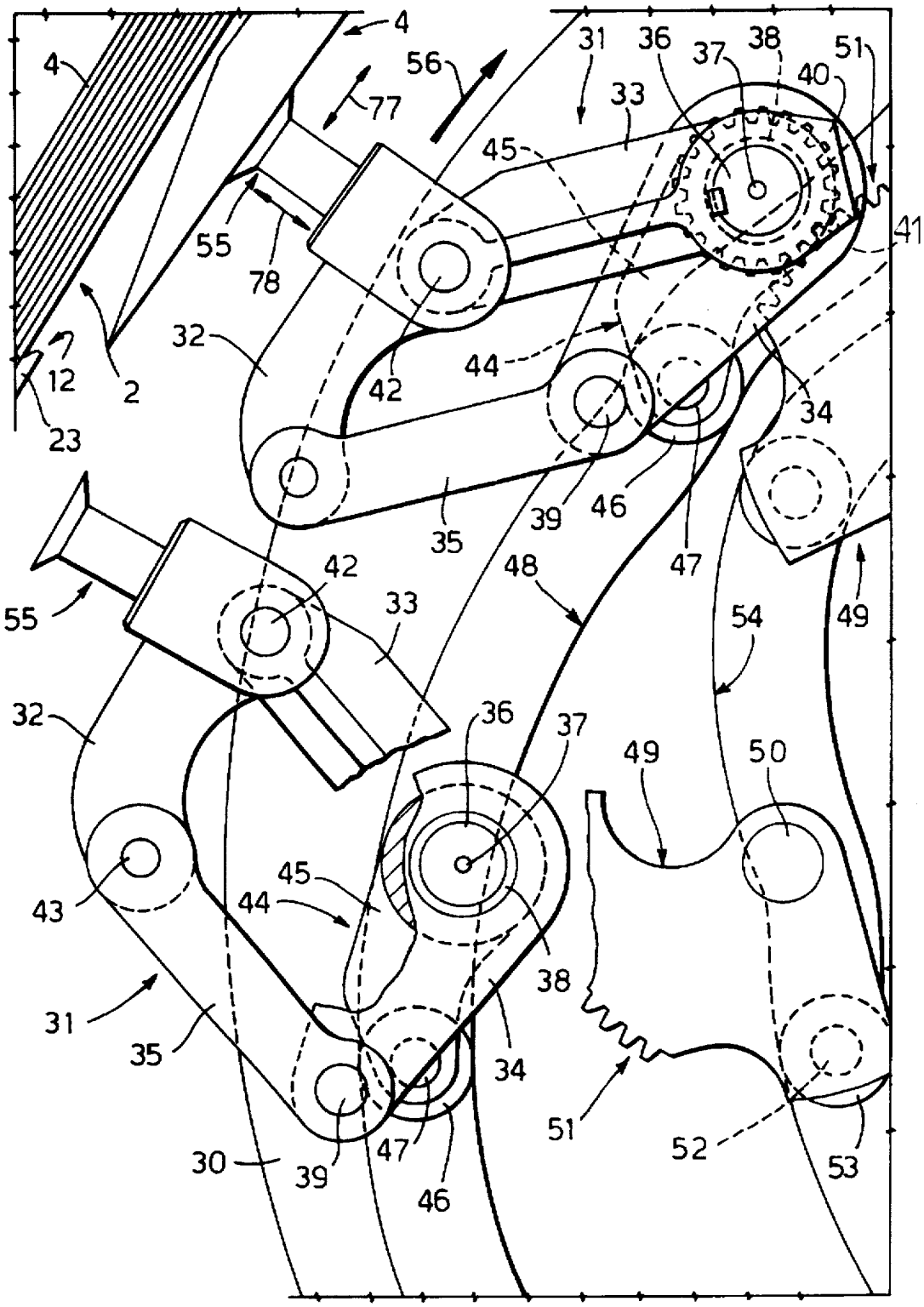
FIG. 2 shows a larger-scale side view, with parts in section and parts removed for clarity, of a detail in FIG. 1.

As shown more clearly in FIG. 2, each unit 25 comprises an articulated parallelogram 31 defined by four rods 32, 33, 34, 35, each opposite pair of which are substantially parallel, and in turn comprising a pin 36 with its axis 37 parallel to axis 28. Pin 36 extends in rotary manner through a sleeve 38 mounted for rotation through wheel 24, and an end portion of which projects on the opposite side of wheel 24 to that facing cam 30. Rod 34 projects radially outwards from said end portion of sleeve 38, and is hinged at its free end to rod 35 by a pin 39 parallel to axis 37. The opposite ends of pin 36 project outwards of sleeve 38, and are fitted respectively with a sleeve 40 on the same side of wheel 24 as rods 34 and 35, and with a gear 41. Rod 33 projects radially outwards from sleeve 40, and is hinged at its free end to one end of rod 32 by a pin 42 parallel to axis 37; and the opposite end of rod 32 is hinged to the free end of rod 35 by a pin 43 parallel to axis 37.

Sleeve 38 presents an end portion (not shown in FIG. 2) projecting from wheel 24 towards cam 30, and fitted with a tappet device 44 comprising a lever 45 extending radially from sleeve 38 and integral with both sleeve 38 and rod 34, and a tappet roller 46 which is mounted for rotation on a pin 47 parallel to axis 37 and fitted to lever 45, and is engaged in rolling manner inside an annular groove 48 of cam 30.

Each unit 25 also comprises a square lever 49 located between wheel 24 and cam 30, and presenting an intermediate portion fitted in rotary manner to a pin 50 parallel to axis 37 and fitted through wheel 24, and a first end shaped to form a sector gear 51 meshing with respective gear 41. The other end of lever 49 is fitted with a pin 52 parallel to axis 37 and idly supporting a tappet roller 53 engaged in rolling manner inside a further annular groove 54 of cam 30.

Finally, each unit 25 also comprises an engaging or gripping member 55 normally in the form of a suction cup, and which is integral with rod 32, is positioned crosswise to rod 32, projects outwards of rod 32 and wheel 24 at pin 42, and travels with wheel 24 about axis 28 and along an annular path in traveling direction 56.

Each unit 25 is assigned a stop device 57 comprising a rod 58 extending substantially radially outwards from wheel 24, and connected integral with wheel 24 on the same side as respective parallelogram 31 and in front of parallelogram 31 in direction 56. The free end of rod 58 is fitted with an inclined plate 59 projecting from rod 58 towards respective parallelogram 31, and which interferes with the path of members 55.

As shown in FIG. 1, filling conveyor 10 is located slightly below wheel 24 and on the opposite side of wheel 24 to feedbox 2, and comprises an annular conveyor chain 60 looped about pulleys 61 (only one shown), one of which is a drive pulley for moving chain 60 anticlockwise in FIG. 1. Chain 60 is defined by a succession of links 62 of given length, from each of which, two substantially parallel rods 63, 64 crosswise to link 62 project outwards and respectively define the rear and front wall of a respective conveyor pocket 65 for receiving a respective expanded or open carton 4.

About pulleys 61, chain 60 defines an upper return branch 66 and a lower forward branch 67 connected to each other, in the traveling direction of chain 60 and at the end of chain 60 facing wheel 24, by a curved branch 68 extending about one of pulleys 61.

The path of members 55 is connected to forward branch 67 of chain 60 by a substantially S-shaped channel 69 extending through transfer station 14 which is diametrically opposite station 13 in relation to wheel 24, and which divides channel 69 into: a first portion 70 extending about the periphery of wheel 24 and defined outwardly by a plate 71 parallel to the FIG. 1 plane and presenting a curved edge 72 extending about the periphery of wheel 24; and a second portion 73 extending outside curved branch 68 and along part of lower forward branch 67. Portion 73 of channel 69 is defined outwardly by a plate 74 parallel to the FIG. 1 plane and presenting a curved edge 75 extending about curved branch 68 and along part of lower branch 67, and is defined inwardly by a curved plate 76 substantially parallel to edge 75 and along which extends a longitudinal opening (not shown in FIG. 1) engaged in sliding manner by rods 63 and 64 which extend through portion 73 to skim edge 75.

Before describing the operation of machine 1, some mention should first be made of the operation of one of units 25, and more specifically of parallelogram 31, alongside variations in the shape of grooves 48 and 54.

By maintaining rod 34 of parallelogram 31 stationary and oscillating rod 33 about axis 37 by means of sector gear 51 and gear 41, it is possible to oscillate the free end of engaging member 55 in one direction or the other about axis 37; and, similarly, by maintaining rod 33 stationary and oscillating rod 34 about axis 37, it is possible to oscillate the free end of engaging member 55 in one direction or the other about the axis of pin 42. In general, therefore, by combining in any number of possible ways the above two oscillations—which may of course be in the same or different directions, or either or both equal to zero—it is possible to impart to the end of member 55 a movement which, viewed from axis 28, may be divided into a first oscillatory movement in relation to wheel 24 and in a shift direction 77 substantially parallel to direction 56, and a second oscillatory movement in a substantially radial gripping direction 78 in relation to wheel 24. More specifically, grooves 48 and 54 may be so formed that, at one or more points along the path followed by member 55, e.g. at station 13, the free end of engaging member 55 is reversed in relation to wheel 24 and in direction 77, thus zeroing the traveling speed of member 55 in direction 56, and so enabling member 55 to move in space solely in direction 78, e.g. to and from and crosswise to the outlet 12 of feedbox 2.

Operation of machine 1 will now be described, for the sake of simplicity, with reference to one unit 25, and as of the instant in which, downstream from transfer station 14, the unloaded unit 25 is fed by wheel 24 towards station 13 where a relative carton 4 is housed inside feedbox 2 and rests on teeth 23 to close outlet 12.

Along a roughly 90° arc downstream from station 14, grooves 48 and 54 remain circular and coaxial with axis 28, so that, as unit 25 travels along this arc, parallelogram 31 rotates unchanged about axis 28, and engaging member 55 is maintained in a substantially radial position in relation to wheel 24. Along the next 90° arc terminating at station 13, however, grooves 48 and 54 depart from their former circular shape. More specifically, groove 54 causes rod 33 to first swing clockwise (in FIGS. 1 and 2) about axis 37 into a forward-tilted position in direction 56 and in relation to the radial plane of wheel 24 through axis 37, and then, as it travels through station 13, to suddenly swing anticlockwise about axis 37 into a backward-tilted position in relation to said radial plane. Similarly, groove 48 is so formed as to cause member 55 to first swing clockwise about the axis of pin 42, and then, as it travels through station 13, to swing anticlockwise into a perfectly radial position in relation to wheel 24, and to remain in this position as rod 33 is suddenly swung backwards.

The speed of the reverse movement imparted to member 55 by rods 33 and 34 at station 13 is such as to momentarily zero the traveling speed of member 55 in direction 56 when member 55 is positioned radially opposite the center line of the upstream wall 5 of layer 9 of carton 4 at outlet 12. In this position, however, as opposed to being stationary in space, member 55, as rod 33 swings backwards about axis 37 from the forward-tilted to the backward-tilted position in relation to said radial plane, oscillates radially in relation to wheel 24, first moving towards and gripping carton 4, and then withdrawing so as to inflect layer 9 at line **7*b* and towards wheel 24, detach layer 9 from layer 8, and at the same time transversely contract carton 4 to enable it to be withdrawn over teeth 23 from outlet 12, in an axial direction in relation to channel 20, and without creasing walls 5 and 6**.

Along the next roughly 120° arc downstream from station 13 in direction 56, member 55 conveys carton 4 in projecting manner; and, on account of the traveling speed in direction 56, the air striking wall 6 of layer 9 tends to maintain carton 4 in the partly expanded or open position. In addition, along this arc, groove 54 is so formed as to swing rod 33 clockwise about axis 37 and bring a central portion of wall 6 of layer 9 into contact with the free edge of plate 59. Further clockwise displacement of rod 33 and simultaneous clockwise rotation of member 55 about the axis of pin 42 by groove 48 cause wall 6 of layer 9 to rotate anticlockwise and outwards in relation to respective wall 5 and about respective line **7*b* which is then inserted beneath plate 59, so that wall 6 is rotated over 90° in relation to respective wall 5 and about respective line 7*b*, which also applies in reverse to walls 5 and 6 of layer 8. In other words, on contacting stop device 57, carton 4 is deformed beyond the fully expanded or open configuration in which each wall 5 is perpendicular to walls 6**, and into a yield configuration in which the carton presents a rhomboidal section.

As it travels along the next roughly 60° arc, member 55 feeds carton 4 along the first portion 70 of channel 69 as the carton is moved outwards of wheel 24 by rod 33 rotating anticlockwise about axis 37, and member 55 rotating clockwise about the axis of pin 42. This outward movement provides for releasing carton 4 from plate 59 and bringing line **7*b* of layer 8 into contact with edge 72 of plate 71 so that carton 4 is maintained in the yield configuration until it reaches station 14 where, still in the yield configuration, it is released by member 55 into the inlet of portion 73 of channel 69**.

Wheel 24 is so timed in relation to conveyor 10 that carton 4 reaches the inlet of portion 73 of channel 69 just after the entry into portion 73 of a pair of rods 63, 64, and just before the entry of the next pair of rods 63, 64, the rod 63 of which defines, with the rod 64 in the previous pair, a pocket 65 for receiving carton 4 maintained in the yield configuration by plate 74 and by plate 76 which is separated from curved edge 75 of plate 74 by a distance less than the width of walls 6.

As shown in FIG. 1, when links 62 are located along the curved branch 68 of chain 60 and hence engage portion 73 of channel 69, the respective rods 63 and 64 defining pockets 65 along portion 73 diverge and are positioned radially in relation to pulley 61, so that each of said pockets 65 is longer than walls 5 and therefore perfectly capable of receiving a respective carton 4 in the yield configuration and pushing it forwards by means of respective rod 63 towards forward branch 67. On passing from branch 68 to branch 67, rods 63 and 64 of each pocket 65 are restored parallel to each other and separated by a distance approximately equal to but no less than the width of walls 5, so as to deform carton 4 from the yield configuration to a stable fully expanded or open configuration wherein walls 5 and 6 are perpendicular, and supply the carton to an axial filling station (not shown).

We claim:

1. A method of expanding and feeding cartons to a pocket conveyor; the cartons being made of sheet material, comprising four walls defined by preformed bend lines, and being expanded to a final parallelogram-section configuration, in which each of adjacent walls of said walls is arranged at right angles, from of an initial flattened configuration wherein each of said cartons is arranged in two superimposed, substantially contacting layers which are integral with each other along two first bend lines of said bend lines, and are each defined by two adjacent walls of said walls of the carton integral with each other along a respective second bend line of said bend lines; comprising initially expanding each said carton to a yield configuration which is reached by rotating each of said walls of each of said layers about an arc of over 90° in relation to the other wall of the same layer past said final configuration, to cause a yielding of the bend lines; maintaining each carton in the yield configuration until the carton is fed into a respective pocket on said pocket conveyor; and allowing each carton to spring back from said yield configuration to said final configuration only within said pocket.

2. A method as claimed in claim 1, wherein each carton is maintained in the yield configuration by feeding the carton along channel means of such a width as to prevent the carton from springing back from the yield configuration to the final configuration.

3. A method as claimed in claim 1, wherein at least part of said rotation of each of said walls of each said carton is performed by engaging a first wall of said walls of a first layer of said layers via engaging means; effecting a first movement of the engaging means in relation to stop means and in a shift direction substantially tangent to said first wall, so as to bring into contact with said stop means an intermediate portion of a second wall of said walls of said first layer, located in front of the respective said first wall in said shift direction; and effecting a second movement of the engaging means in relation to the stop means in said shift direction, so as to position the second bend line of the first layer beyond the stop means.

4. A method as claimed in claim 3, wherein said first and second movements are part of an oscillatory movement of said engaging means.

5. A method as claimed in claim 3, wherein retaining means are provided to retain said cartons in said initial configuration, an initial portion of said rotation of each of said walls of each said carton being performed by effecting, in a gripping direction substantially crosswise to the first wall and in opposition to said retaining means, which engage the carton at said first bend lines, a third movement of said engaging means in relation to said retaining means to release the carton from the retaining means and achieve a partial expansion of the carton.

6. A method as claimed in claim 5, wherein at least part of said rotation of each of said walls of each said carton is performed by moving said engaging means and respective said stop means along a given path via conveyor means traveling at a given speed in a given traveling direction; said first and second movements being relative movements in relation to said conveyor means.

7. A method as claimed in claim 6, wherein said stop means are fixed in relation to said conveyor means; said first and second movements being effected by moving the engaging means reciprocatingly to and from the respective said stop means and in relation to the conveyor means.

8. A method as claimed in claim 7, wherein said reciprocating movement comprises a reversing portion in relation to said traveling direction; said reversing portion being partly performed by said engaging means at a speed equal to and opposite to said given speed to arrest the engaging means in space at a given stop station located along said path.

9. A method as claimed in claim 8, wherein said retaining means are located at said stop station; said third movement being effected by imparting to the engaging means a reciprocating movement substantially crosswise to said traveling direction.

10. A method as claimed in claim 9, wherein said movements are controlled by fixed cam means.

11. A method as claimed in claim 10, wherein said engaging means extend from a first rod of an articulated parallelogram comprising four rods; a second rod of said rods being hinged at one end to a corresponding end of the first rod and at the other end to said conveyor means so as to rotate, in relation to the conveyor means, about an axis crosswise to said traveling direction; and a third rod of said rods being hinged at one end to said conveyor means so as to rotate, in relation to the conveyor means, about said axis, and being hinged at the other end to a corresponding end of a fourth rod of said rods interposed between the third rod and an opposite end of the first rod to that connected to the second rod; said movements being imparted to said engaging means by controlling angular positions of said second and third rods about said axis via respective tappet means fitted to respective said cam means.

12. A method as claimed in claim 11, wherein said movements are imparted to said engaging means by oscillating said second and third rods in a controlled manner about said axis via said tappet means.

* * * * *